US010858894B2

(12) United States Patent
Boddeda et al.

(10) Patent No.: US 10,858,894 B2
(45) Date of Patent: Dec. 8, 2020

(54) HYDRAULICALLY ACTUATED SAFETY SUB

(71) Applicant: Enventure Global Technology, Inc., Houston, TX (US)

(72) Inventors: Nanda Kishore Boddeda, Houston, TX (US); Frederick Cornell Bennett, Houston, TX (US)

(73) Assignee: Enventure Global Technology, Inc., Houston, TX (US)

( * ) Notice: Subject to any disclaimer, the term of this patent is extended or adjusted under 35 U.S.C. 154(b) by 0 days.

(21) Appl. No.: 16/479,508

(22) PCT Filed: Jan. 24, 2018

(86) PCT No.: PCT/US2018/014997
§ 371 (c)(1),
(2) Date: Jul. 19, 2019

(87) PCT Pub. No.: WO2018/140462
PCT Pub. Date: Aug. 2, 2018

(65) Prior Publication Data

US 2019/0383107 A1 Dec. 19, 2019

Related U.S. Application Data

(60) Provisional application No. 62/449,866, filed on Jan. 24, 2017.

(51) Int. Cl.
*E21B 17/06* (2006.01)
*E21B 17/02* (2006.01)
*E21B 17/042* (2006.01)

(52) U.S. Cl.
CPC ..... *E21B 17/06* (2013.01); *E21B 17/021* (2013.01); *E21B 17/042* (2013.01)

(58) Field of Classification Search
CPC ..... E21B 17/021; E21B 17/02; E21B 17/06; E21B 23/0413; E21B 17/042
See application file for complete search history.

(56) References Cited

U.S. PATENT DOCUMENTS 1,883,071 A 10/1932 Stone
3,179,180 A 4/1965 Hart
(Continued)

OTHER PUBLICATIONS

International Search Report and Written Opinion dated Apr. 13 2018 for corresponding WO Patent Application No. PCT/US18/14997, 8 pages.

(Continued)

*Primary Examiner* — Brad Harcourt
(74) *Attorney, Agent, or Firm* — Jonathan Pierce; Pierre Campanac; Porter Hedges LLP

(57) ABSTRACT

A safety joint having threads with a first handedness, for example right-handed threads, to connect the safety joint to an upper drill pipe portion and a lower drill pipe portion. The safety joint includes a releasable threaded connection having a second handedness inverse of the first handedness. The safety joint also includes a hydraulically actuated piston sleeve that locks rotation across the releasable threaded connection. Disconnecting the upper drill pipe portion from the lower drill pipe portion is achieved by moving the piston sleeve to a position wherein the piston sleeve does not transmit rotation across the releasable threaded connection, and rotating the upper drill pipe portion in the first handedness direction to unscrew the releasable threaded connection.

15 Claims, 3 Drawing Sheets

(56) References Cited

U.S. PATENT DOCUMENTS

| | | | | |
|---|---|---|---|---|
| 3,895,829 | A | 7/1975 | Manson, Jr. | |
| 4,658,895 | A | 4/1987 | Brisco | |
| 6,186,249 | B1 * | 2/2001 | Bjornstad | E21B 17/06 166/242.6 |
| 7,055,607 | B2 | 6/2006 | Jacob et al. | |
| 9,512,683 | B2 | 12/2016 | Akkerman et al. | |
| 2008/0099210 | A1 * | 5/2008 | Gazewood | E21B 17/06 166/377 |
| 2009/0301711 | A1 | 12/2009 | Jagert et al. | |
| 2014/0034332 | A1 | 2/2014 | Allamon et al. | |

OTHER PUBLICATIONS

Supplementary European Search Report of corresponding EP app. No. 18744789.1 dated Aug. 25, 2020, 7 pages.

* cited by examiner

HYDRAULICALLY ACTUATED SAFETY SUB

CROSS-REFERENCE TO RELATED APPLICATIONS

This application is a National Stage Entry of International Application serial number PCT/US2018/014997, filed on Jan. 24, 2018. International Application serial number PCT/US2018/014997 claims priority to provisional application Ser. No. 62/449,866, filed on Jan. 24, 2017. All priority applications are included herein by reference.

BACKGROUND

This disclosure generally relates to methods and apparatus for disconnecting a lower portion of a drill pipe disposed in a wellbore. The disclosure relates more particularly to a downhole tool, referred to herein as a safety joint, for incorporation in a drill pipe above the lower portion of the drill pipe to be disconnected. The safety joint includes a releasable threaded connection that may be unscrewed when the drill pipe is in the wellbore.

The releasable threaded connection of the safety joint, like the other threaded connections in the drill pipe, is typically right-handed, meaning that the connections are made up by applying a clockwise torque to the upper member of the connection to screw it to the lower member of the connection. When disconnection from a lower portion of the drill pipe is desired, a counter-clockwise torque is applied to the drill pipe at the surface. Because the breakup torque of the safety joint is the lowest, the drill pipe usually unscrews at the safety joint.

The upper portion of the drill pipe located between the drilling rig and the safety joint may contact the wellbore wall and generate friction. This friction increases the counter-clockwise torque that needs to be applied to the drill pipe at the surface to overcome the breakup torque of the safety joint. The effect of friction can be problematic in deep-water wells or in highly deviated wells. There, the counter-clockwise torque that needs to be applied to the drill pipe at the surface to overcome both the friction and the breakup torque of the safety joint may become so large that it can exceed the breakup torque of a threaded connection in the drill pipe, wherein the threaded connection is not the safety joint. When the counter-clockwise torque applied to the drill pipe at the surface is this large, the drill pipe can disconnect at a non-desired location.

Thus, there is a continuing need in the art for methods and apparatus for selectively releasing the threaded connection of a safety joint while still preventing unintended unscrewing of the other threaded connections in the drill pipe.

SUMMARY OF THE DISCLOSURE

In one aspect, the disclosure describes a method of using a safety joint. The safety joint includes an upper sub having an upper central passageway. The safety joint further includes a first thread and a second thread. The first thread has a first handedness and the second thread has a second handedness that is the inverse of the first handedness. The first handedness direction may preferably be right-handed, and the second handedness direction may preferably be left-handed. The safety joint also includes a middle sub having a middle central passageway. The method may comprise assembling the safety joint by performing the steps of providing the first and middle subs, sliding a piston sleeve within the middle central passageway, and connecting the upper sub to the middle sub by rotating the upper sub relative to the upper sub in the second handedness direction. The method may further comprise positioning the piston sleeve in a first position wherein the piston sleeve transmits rotation of the upper sub to the middle sub. Transmitting rotation of the upper sub to the middle sub may be performed via a spline protruding radially from a body of the piston sleeve. For rotation transmission, the spline may further engage a first internal groove of the upper sub and a second internal groove of the middle sub. A lower sub may be connected below the middle sub.

The method may further comprise assembling a drill pipe string by performing the steps of connecting the upper sub to an upper drill pipe portion using the first thread, and operatively coupling the middle sub to a lower drill pipe portion. Coupling the middle sub to the lower drill pipe portion may comprise connecting the lower sub to the lower drill pipe portion.

The method may further comprise rotating the upper drill pipe portion in the first handedness direction without disconnecting the upper drill pipe portion from the lower drill pipe portion when the piston sleeve is in the first position. The method may further comprise disconnecting the upper drill pipe portion from the lower drill pipe portion when using the drill pipe string in a wellbore. Disconnecting the upper drill pipe portion from the lower drill pipe portion involves moving the piston sleeve to a second position wherein the piston sleeve does not transmit rotation of the upper sub to the middle sub, and rotating the upper drill pipe portion in the first handedness direction. Moving the piston sleeve to the second position may be performed using hydraulic pressure of a fluid flowing in the upper central passageway. For example, the method may involve dropping an obstruction in the upper drill pipe portion, sealing the obstruction against a seat of the piston sleeve, and shearing a shear pin retaining the piston sleeve in the first position.

In one aspect, the disclosure describes a safety joint for disconnecting an upper drill pipe portion from a lower drill pipe portion. The safety joint comprises an upper sub having an upper central passageway, a middle sub having a middle central passageway, and a piston sleeve slidable within the middle central passageway. The piston sleeve has a first position wherein the piston sleeve transmits rotation of the upper sub to the middle sub, and a second position wherein the piston sleeve does not transmit rotation of the upper sub to the middle sub. The upper sub has a first thread for connecting the upper sub to the upper drill pipe portion and a second thread for connecting the upper sub to the middle sub. The first thread has a first handedness and the second thread has a second handedness inverse of the first handedness. For example, the upper sub may have a first end and a second end opposite the first end. The first thread may be located on the first end of the upper sub, and the second thread may be located on the second end of the upper sub. The middle sub may have a third thread located at a first end of the middle sub for connecting the middle sub to the upper sub, and a fourth thread located at a second end of the middle sub, which is opposite the first end of the middle sub. The third thread has the second handedness, and the fourth thread may have the first handedness. The first thread and the fourth thread may be right-handed, and the second thread and the third thread may be left-handed.

The piston sleeve may be retained in the first position using a shear pin. To transmits rotation of the upper sub to the middle sub while in the first position, the piston sleeve including a spline protruding radially from a body of the piston sleeve. The upper sub may have a first internal groove extending radially from the upper central passageway, and the spline may selectively engage the first internal groove. The middle sub may also have a second internal groove extending radially from the middle central passageway, and the spline of the piston sleeve may engage the second internal groove.

The piston sleeve may move to the second position by hydraulic actuation. For example, the piston sleeve may include a seat for sealing against an obstruction dropped in the upper drill pipe portion. A lower sub connected between the middle sub and the lower drill pipe portion may comprise a lower central passageway for receiving the piston sleeve in the second position.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
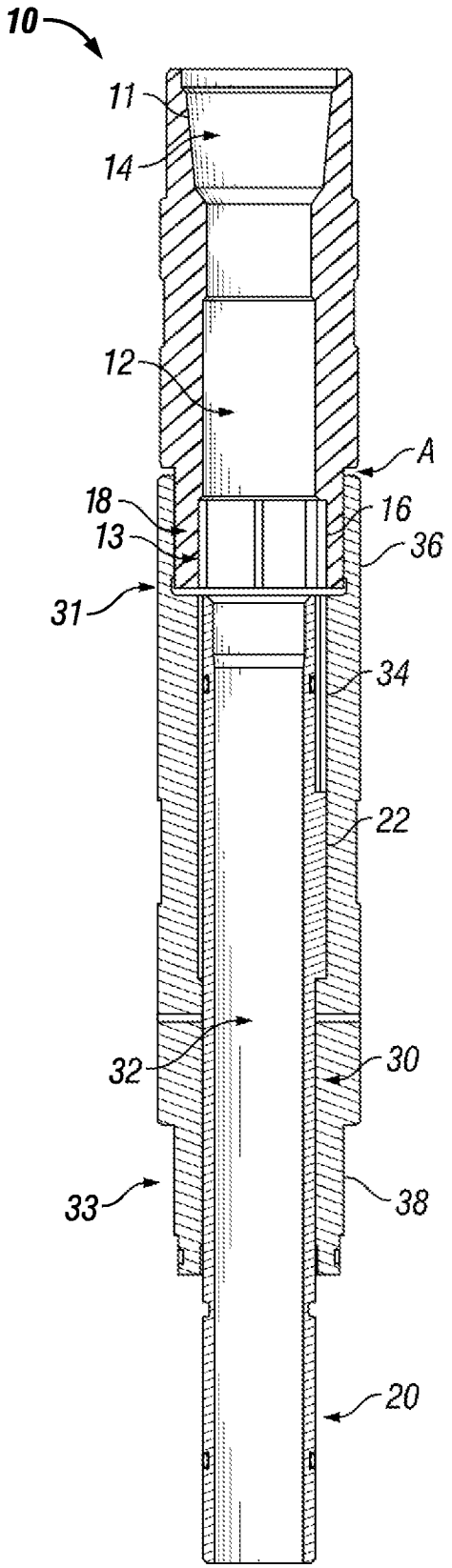
FIGS. 1, 2, and 3 are a sequence of sectional views illustrating assembly a safety joint.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

All numerical values in this disclosure may be exact or approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following discussion and in the claims, the terms "including" and "comprising" are used in an open-ended fashion, and thus should be interpreted to mean "including, but not limited to." Furthermore, as it is used in the claims or specification, the term "or" is intended to encompass both exclusive and inclusive cases, i.e., "A or B" is intended to be synonymous with "at least one of A and B," unless otherwise expressly specified herein.

Certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

Referring to FIG. 1, a safety joint includes an upper sub 10 having an upper central passageway 12, a first thread 14 for connecting the upper sub 10 to an upper drill pipe portion 50, and a second thread 18 for connecting the upper sub 10 to a middle sub 30. The first thread 14 has a first handedness and the second thread 18 has a second handedness inverse of the first handedness. The first handedness direction is preferably right-handed, and the second handedness direction is preferably left-handed. In the example shown, the upper sub 10 may have a first end 11 and a second end 13 opposite the first end 11. The first thread 14 may be located on the first end 11 of the upper sub 10, and the second thread 18 may be located on the second end 13 of the upper sub 10.

The middle sub 30 has a middle central passageway 32. The middle sub 30 may have a third thread 36 located at a first end of the middle sub 31 for connecting the middle sub 30 to the upper sub 10, and a fourth thread 38 located at a second end of the middle sub 33 opposite the first end of the middle sub 31. The third thread 36 has the second handedness, and the fourth thread may have the first handedness. Thus, the fourth thread 38 may be right-handed, and the third thread 36 may be left-handed.

To assemble the safety joint, a piston sleeve 20 is first slid within the middle central passageway 32, and the upper sub 10 is connected to the middle sub 30 by rotating the upper sub 10 relative to the middle sub 30 in the second handedness direction. The rotation is stopped when a spline 22 protruding radially from a body of the piston sleeve 20 is aligned with a first internal groove 16 of the upper sub 10. Preferably, a gap A is left between thread shoulders of the upper sub 10 and the middle sub 30.

Figure 2:
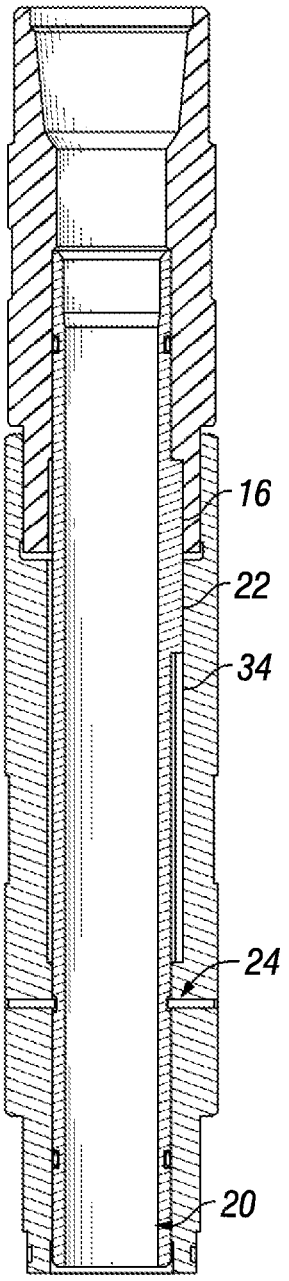

Turning to FIG. 2, the piston sleeve 20 is positioned in a first position wherein the piston sleeve 20 transmits rotation of the upper sub 10 to the middle sub 30. The piston sleeve 20 may be retained in the first position using a shear pin 24. To transmits rotation of the upper sub 10 to the middle sub 30 while in the first position, the piston sleeve 20 including a spline 22 protruding radially from a body of the piston sleeve 20. In the example shown, the upper sub 10 may have a first internal groove 16 extending radially from the upper central passageway 12, and the spline 22 may selectively engage the first internal groove 16. The middle sub 30 may also have a second internal groove 34 extending radially from the middle central passageway 32, and the spline 22 of the piston sleeve 20 may engage the second internal groove 34.

Figure 3:
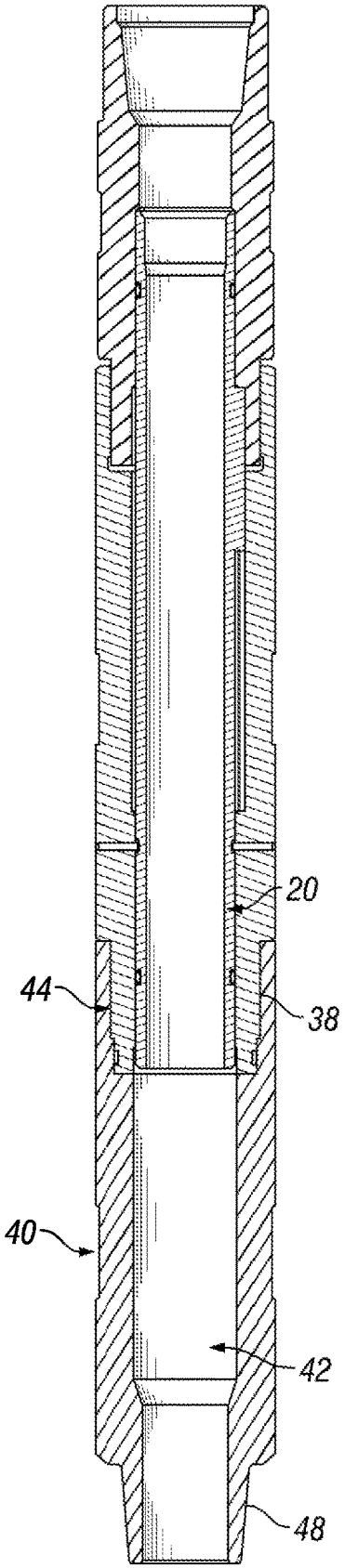

Turning to FIG. 3, a lower sub 40 may be connected to the middle sub 30. The lower sub 40 may comprise a lower central passageway 42 sized for receiving the piston sleeve 20 when the piston sleeve 20 moves to the second position. The lower sub 40 may include a fifth thread 44 and a sixth thread 48, both of which having the first handedness.

Figure 4:
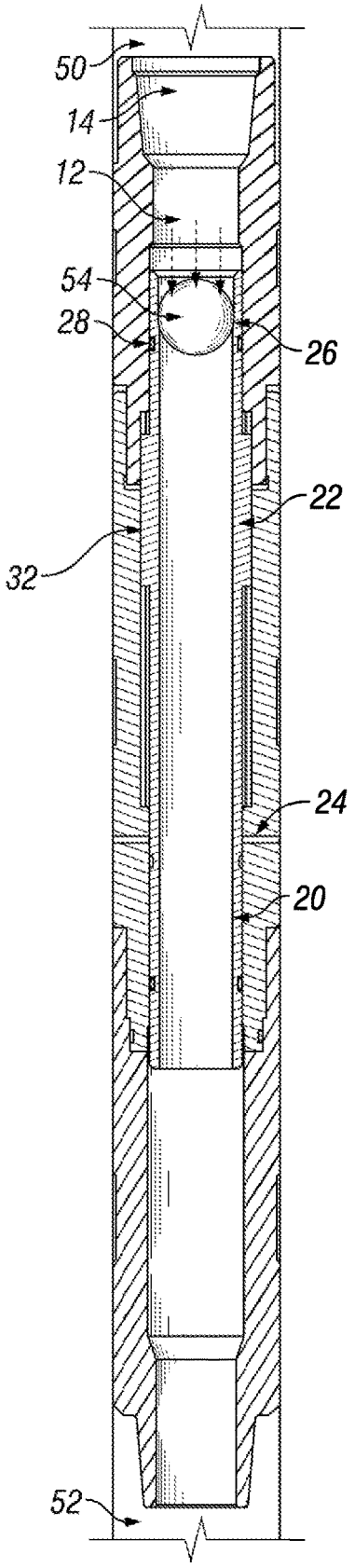
FIGS. 4, 5, and 6 are a sequence of sectional views illustrating the release of the safety joint shown in FIG. 3.

Turning to FIG. 4, the safety joint is shown assembled within a drill pipe string. The upper sub 10 is connected to an upper drill pipe portion 50 using the first thread 14. The middle sub 30 is operatively coupled to a lower drill pipe portion 52. In the example shown, the middle sub 30 is operatively coupled to the lower drill pipe portion 52 by connecting the lower sub 40 between the middle sub 30 and the lower drill pipe portion 52. In the configuration shown in FIG. 4, wherein the piston sleeve 20 is in the first position, the upper drill pipe portion 50 can be rotated in the first handedness direction without disconnecting the upper drill pipe portion 50 from the lower drill pipe portion 52.

The upper drill pipe portion 50 may be disconnected from the lower drill pipe portion 52 when using the drill pipe string in a wellbore. For disconnecting the upper drill pipe portion 50 from the lower drill pipe portion 52, the piston sleeve 20 may first be moved to the second position. The piston sleeve 20 may move to the second position by hydraulic actuation. For example, the piston sleeve 20 may include a seat 26 for sealing against an obstruction 54 dropped in the upper drill pipe portion 50. Further, the piston sleeve 20 may include a seal 28 for sealing against the upper central passageway 12 and/or the middle central passageway 32. The shear pin 24 retaining the piston sleeve 20 in the first position may shear under the action of the hydraulic pressure of fluid in the upper central passageway 12 above the obstruction 54, the seat 26, the piston sleeve 20, and the seal 28.

Figure 5:
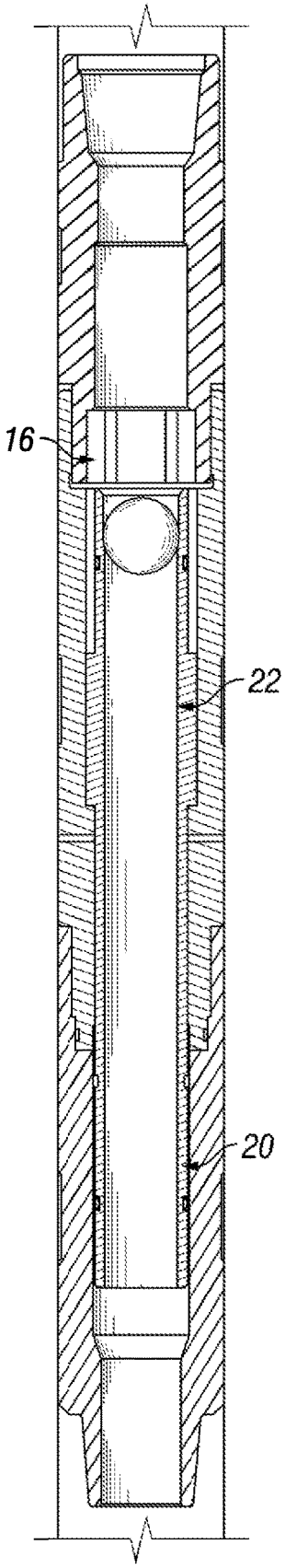

Turning to FIG. 5, the piston sleeve 20 has moved to the second position wherein the piston sleeve 20 does not transmit rotation of the upper sub 10 to the middle sub 30. In the configuration shown in FIG. 5, the spline 22 does not engage the first internal groove 16.

Figure 6:
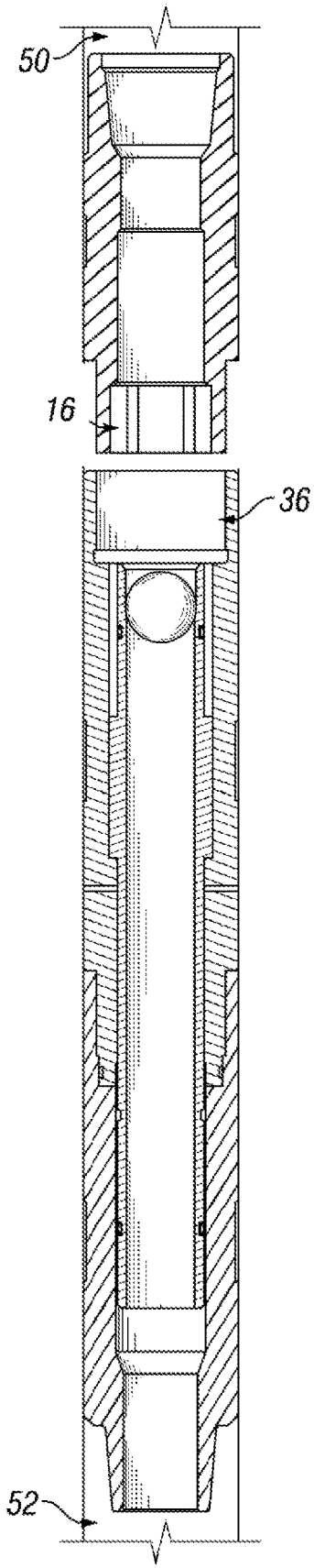

Turning to FIG. 6, the upper drill pipe portion 50 may be rotated in the first handedness direction to release the safety joint.

In certain embodiments, the safety joint is configured such that torque applied to the drill pipe at the surface is not retained in the releasable connection (i.e., between the second and third thread). Because the safety joint does not retain torque, after the piston sleeve is shifted from the first position to the second position, the only torque needed to disconnect the releasable connection is the torque required to overcome friction between the drill pipe and the wellbore wall. Thus, a safety joint with a releasable connection designed to disconnect by turning to the right guarantees that no standard drill pipe connection will be broken out in the process (as they are broken by turning to the left). In contrast, a safety joint with a releasable connection designed to disconnect by turning to the left must be designed to require much less torque to breakout than any of standard drill pipe connections in the drill string.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents and alternatives falling within the scope of the claims.

What is claimed is:

1. A safety joint for disconnecting an upper drill pipe portion from a lower drill pipe portion, the safety joint comprising:

an upper sub having an upper central passageway;

a middle sub having a middle central passageway; and a piston sleeve slidable within the middle central passageway, the piston sleeve having a first position wherein the piston sleeve transmits rotation of the upper sub to the middle sub, and a second position wherein the piston sleeve does not transmit rotation of the upper sub to the middle sub and clears the upper sub, wherein the piston sleeve includes a seat for sealing against an obstruction dropped in the upper drill pipe portion, the seat being configured such that the obstruction, once it has landed on the seat, is recessed below a top of the piston sleeve, wherein the upper sub has a first thread for connecting the upper sub to the upper drill pipe portion and a second thread for connecting the upper sub to the middle sub, and wherein the first thread has a first handedness and the second thread has a second handedness, inverse of the first handedness.

2. The safety joint of claim 1, wherein the upper sub has a first end and a second end opposite the first end, and wherein the first thread is located at the first end of the upper sub, and the second thread is located at the second end of the upper sub.

3. The safety joint of claim 2, wherein the middle sub has a third thread located at a first end of the middle sub for connecting the middle sub to the upper sub, and a fourth thread located at a second end of the middle sub opposite the first end of the middle sub, and wherein the third thread has the second handedness and the fourth thread has the first handedness.

4. The safety joint of claim 3, wherein the first thread and the fourth thread are right-handed, and wherein the second thread and the third thread are left-handed.

5. The safety joint of claim 1, wherein the upper sub has a first internal groove extending radially from the upper central passageway, and wherein the piston sleeve including a spline protruding radially from a body of the piston sleeve, and selectively engaging the first internal groove.

6. The safety joint of claim 5, wherein the middle sub has a second internal groove extending radially from the middle central passageway, and the spline of the piston sleeve engages the second internal groove.

7. The safety joint of claim 1, wherein the piston sleeve is retained in the first position using a shear pin, wherein the piston sleeve remains in the second position after shearing of the shear pin such that a space inside a thread of the middle sub remains unobstructed.

8. The safety joint of claim 7, further comprising a lower sub connected between the middle sub and the lower drill pipe portion, wherein the lower sub comprises a lower central passageway for receiving the piston sleeve in the second position.

9. A method of using a safety joint, the method comprising:

providing an upper sub having an upper central passageway, a first thread, and a second thread, wherein the first thread has a first handedness and the second thread has a second handedness inverse of the first handedness;

providing a middle sub having a middle central passageway;

sliding a piston sleeve within the middle central passageway, connecting the upper sub to the middle sub by rotating the upper sub relative to the upper sub in the second handedness direction;

positioning the piston sleeve in a first position wherein the piston sleeve transmits rotation of the upper sub to the middle sub;

connecting the upper sub to an upper drill pipe portion using the first thread;

coupling the middle sub to a lower drill pipe portion;

dropping an obstruction in the upper drill pipe portion;

sealing the obstruction against a seat of the piston sleeve, the seat being configured such that the obstruction, once it has landed on the seat, is recessed below a top of the piston sleeve; and disconnecting the upper drill pipe portion from the lower drill pipe portion by moving the piston sleeve to a second position wherein the piston sleeve does not transmit rotation of the upper sub to the middle sub and clears the upper sub, and rotating the upper drill pipe portion in the first handedness direction.

10. The method of claim 9, further comprising rotating the upper drill pipe portion in the first handedness direction without disconnecting the upper drill pipe portion from the lower drill pipe portion when the piston sleeve is in the first position.

11. The method of claim 9, wherein moving the piston sleeve to the second position is performed using hydraulic pressure of a fluid flowing in the upper central passageway.

12. The method of claim 9, further comprising shearing a shear pin retaining the piston sleeve in the first position, wherein the piston sleeve remains in the second position after shearing of the shear pin such that a space inside a thread of the middle sub remains unobstructed.

13. The method of claim 9, further comprising transmitting rotation of the upper sub to the middle sub via a spline protruding radially from a body of the piston sleeve, the spline engaging a first internal groove of the upper sub and a second internal groove of the middle sub.

14. The method of claim 9, wherein coupling the middle sub to the lower drill pipe portion comprises connecting a lower sub between the middle sub and the lower drill pipe portion.

15. The method of claim 9, wherein the first handedness direction is right-handed, and the second handedness direction is left-handed.

* * * * *